US006182937B1

(12) United States Patent
Sanderse

(10) Patent No.: US 6,182,937 B1
(45) Date of Patent: Feb. 6, 2001

(54) MULTI-PURPOSE WALL MOUNTING

(75) Inventor: Frans Jan Pieter Sanderse, Harskamp (NL)

(73) Assignee: Waterlandse Beheermaatschappij A. Witkamp & Zonen BV (NL)

( * ) Notice: Under 35 U.S.C. 154(b), the term of this patent shall be extended for 0 days.

(21) Appl. No.: 09/355,695

(22) PCT Filed: Jan. 29, 1998

(86) PCT No.: PCT/DE98/00271

§ 371 Date: Nov. 19, 1999

§ 102(e) Date: Nov. 19, 1999

(87) PCT Pub. No.: WO98/33415

PCT Pub. Date: Aug. 6, 1998

(30) Foreign Application Priority Data

Jan. 31, 1997 (DE) ..... 197 03 536

(51) Int. Cl.[7] ..... A47F 5/01; A47F 1/14; A47G 1/16; B60R 1/02

(52) U.S. Cl. ..... 248/466; 248/220.31; 248/223.41; 248/224.7; 248/235; 248/239; 248/247; 248/242; 248/243; 248/250; 411/400; 411/401; 411/485; 211/106.01

(58) Field of Search ..... 248/466, 220.31, 248/223.41, 224.7, 235, 220.21, 220.22, 239, 247, 242, 243, 250; 411/400, 401, 485, 480, 396; 211/59.1, 105.1, 106.01, 193

(56) References Cited

U.S. PATENT DOCUMENTS 5,205,524 * 4/1993 Cohen ..... 248/222.1
5,505,314 * 4/1996 O'Brien ..... 211/59.1

* cited by examiner

*Primary Examiner*—Leslie A. Braun
*Assistant Examiner*—A. Joseph Wujciak, III
(74) *Attorney, Agent, or Firm*—Robert W. Becker & Associates

(57) ABSTRACT

A positive-locking wall mounting combination has a wall mounting with a hollow cylindrical body having an outer mantle, an inner mantle, and a bottom. The bottom has a slotted hole having a length that is shorter than an inner diameter of an inner circular surface described by the inner mantle. The slotted hole has a longitudinal axis intercepting a center of the inner circular surface. The outer mantle has an upper end and a lip connected to the upper end. The lip extends annularly about the outer mantle. An L-shaped support member is positive-lockingly inserted into the slotted hole.

10 Claims, 2 Drawing Sheets

MULTI-PURPOSE WALL MOUNTING

BACKGROUND OF THE INVENTION

The invention relates to a device for positive locking connection of a wall mounting with a support member by hooking, wherein the wall mounting is a hollow cylindrical body with an outer mantle, an inner mantle, and a bottom, and wherein the support member is preferably L-shaped.

Wall mountings are known in the prior art in which, for example, metal strip brackets are mounted on a wall to which support brackets can be coupled. For example, the perforated strip brackets are fastened by plug and screw anchors in a time consuming operation to the wall, and the support brackets are then hooked in or suspended from the holes in the perforated strip bracket. The support brackets receive shelf boards. Not only is the connection by plug and screw anchors, requiring multiple such anchors, time consuming for each one of the perforated strip brackets and thus work intensive, but the connection requires also a certain amount of manageability and dexterity by the user. The conventional wall shelves are sufficient when it is not necessary to load the shelves too much, but already when placing books etc. onto the shelves, there is the risk that the stress over time will cause the perforations of the perforated strip brackets to become fractured because of material fatigue or to rip. At least the suspension location of the support bracket hooks, having a thickness matching substantially that of the wall thickness of the support brackets, become overextended in the holes of the perforated strip bracket so that there is the risk of breakage.

In order to prevent the support members from breaking out of the perforated strip brackets, the support members according to the prior art are fastened by plug and screw anchors to the walls. However, this again requires a lot of time and great dexterity of the user.

Further developments of such support bracket systems as self-locking support bracket systems with square or U-shaped columns with double support brackets do not eliminate the disadvantages with respect to footprint size requirements.

In conventional flat wall strip brackets, the shelf boards are supported on cylindrical support pins which are inserted into matching holes of the perforated strip bracket. The uniform distribution of these holes makes it possible to move the support pins and thus the individual shelf boards, but the wall strip brackets are not suitable for medium weight objects to be stored thereon because of the minimal wall strip bracket thickness. The U-shaped wall strip brackets with supports are more stable than the flat ones and provide a sufficient stability and load carrying capacity, but their application is substantially limited by the large amount of wall surface area needed.

Furthermore, the attachment of conventional perforated brackets results in a limitation of the design possibilities and attachment possibilities of shelf boards because a sufficient amount of wall surface area must be provided for attaching at least two such perforated brackets.

SUMMARY OF THE INVENTION

It is an object of the present invention to provide a device which eliminates the aforementioned disadvantages of the prior art. Furthermore, the device should be easily attachable to walls and allow easy coupling or hooking, respectively, unhooking of support members which are to be attachable in a variable manner, while, at the same time, sufficient flexibility, for a customized design and arrangement at the wall should be provided. Furthermore, the device should require less assembly time and should be less labor-intensive while at the same time having a high load carrying capacity. These objects are solved by the inventive device of the independent claim. The dependent claims relate to preferred embodiments of the inventive device.

The invention relates to a device for a positive-locking connection of a wall mounting and a support member by hooking or suspending, whereby the wall mounting is a hollow cylindrical body with an outer mantle, an inner mantle, and a bottom. The wall mounting is characterized in that the bottom has a perforated hole, the length of the perforated hole being shorter than the inner diameter of the inner circle described by the inner mantle within the hollow space of the hollow cylindrical body. The longitudinal axis of the perforated hole intercepts the center point of the circle of the inner circular surface and/or of the outer circular surface, respectively, the cylinder axis of the hollow cylinder. At the upper end of the outer mantle a lip is arranged which extends annularly about the outer mantle. The support member is L-shaped.

The inventive device for a positive-locking connection of the wall mounting and a support member is embodied as a hollow cylindrical body. The hollow cylindrical body is preferably of a circular cylindrical design and, even more preferred, of a hollow cylindrical design. The body has an interior with a cylinder axis, also referred to as hollow cylinder axis. The surface of the bottom facing the interior corresponds to the inner circular surface. The surface of the bottom facing away from the interior is the outer circular surface having a center of a circle. The preferably circular cylindrically designed inner mantle describes or delimits the inner circular surface having a center of a circle. The centers of the circle of the inner and outer circular surfaces advantageously coincide. Also, the outer mantle of the body can describe or delimit the outer circle or circular surface, having a center that can correspond to that one of the inner circle. The inner circular surface at the lower end and the inner circular surface at the upper end of the body may be identical. The outer circular surface at the lower end and the outer circular surface at the upper end of the body may be identical. The straight line connecting the centers of the outer circular surface and of the inner circular surface can determine the cylinder axis or hollow cylinder axis. The bottom has an elongate hole, for example, a slotted hole. The elongate hole is oriented such that the longitudinal axis of the slotted hole intercepts the center of the inner circular surface. The two ends of the slotted hole are spaced from the inner mantle. In a further embodiment the spacing of the two ends of the slotted hole from the inner mantle are identical.

Furthermore, the hollow cylindrical body has a lip at the upper end of the outer mantle, wherein the surface of the lip facing the lower end of the outer mantle is advantageously perpendicularly arranged to the outer mantle. The lip can also be of an annular design extending about the bottom. The bottom and the lip are embodied advantageously as a unitary part. The lip can have an angular, such as quadrangular or hexagonal shape, or be circular, depending on the wishes of the user or the technical requirements. Even more advantageous is the unitary or monolithic design of the wall mounting.

After drilling a hole into a wall, having a diameter which corresponds substantially to the diameter of the outer circle described by the outer mantle, wherein minimal deviations are not impairing the mounting action, the body is inserted into the hole to such an extent that the surface of the lip which faces the lower end of the outer mantle or the body, is arranged at the wall as flush as possible. It is understood that the diameter of the hole in the wall should be matched to the outer circle as closely as possible. However, if there is a minimal difference between the two diameters, a sufficient coupling between the wall and the wall mounting of the inventive device is substantially ensured. Furthermore, when the hole has a slightly smaller diameter in comparison to that of the outer circular surface, a positive-locking connection is ensured in a sufficient manner after insertion of the body by means of slightly hammering or rotating of the outer mantle of the body provided with projections and/or depressions (see below). It may even be further enhanced by a frictional and/or positive-locking connection of the wall and the body.

In one embodiment of the inventive device, the outer mantle has projections and/or depressions which increase the frictional connection between the body of the wall mounting and the wall. The projections and/or depressions can be groove-shaped and/or embodied as a thread. The projections and/or depressions can be aligned concentrically about the center of the outer circular surface. The grooves enhance in an advantageous manner also the positive-locking connection of the body of the wall mounting with the wall. In a further preferred embodiment, the projections can be arranged along the cylinder axis and may then be provided at the upper end of the body with hook-shaped stays.

The wall mounting of the inventive device is inserted into the hole of the wall such that the slotted hole at the bottom is substantially perpendicular or vertical. The support member of the inventive device is advantageously L-shaped. One leg of the support member is arranged at a right angle to the other leg whereby the other leg has a transition into a portion which may be angled relative to the other leg. However, the angled arrangement depends on its function. For example, the other leg can also extend straight for receiving shelf boards. Moreover, the angled portion can be arranged at an angle of more than 90° or 90° to 150° relative to the other leg. The angled arrangement of the angled portion relative to the other leg depends on the function of the support member. The angled arrangement can also be embodied as an upright clothes rack or as a rod with clothes hooks. Multiple support members can be provided as supports for receiving shelf boards. It is also possible that one support member has multiple coupled supports arranged underneath one another. Furthermore, one support member can have at least two horizontally arranged supports that, because of the sufficient non-positive form and/or positive-locking connection of the wall mount with the wall, can be used for receiving objects of medium weight or heavy weight. Surprisingly, in contrast to the prior art, a simple and less time consuming application of one or two holes in the wall and a simple insertion of the wall mounting with the support member according to the inventive device, instead of the cumbersome plug and screw anchor attachment, provides shelf systems for use in homes as well as for commercial use, suspending arrangements for light, medium weight, or heavy objects such as tires, tools, clothing etc., or holders for machines etc. without requiring dexterity and mechanical aptitude of the user.

After insertion of the wall mounting in the hole of the wall, the support member, for mounting in the wall mounting, is inserted with one leg and the other leg to such an extent into the slotted hole of the bottom of the wall mounting, and then aligned such that the portion of one leg which projects at a right angle past the other leg comes to rest at a portion of the bottom serving substantially as an abutment surface. This portion of the bottom may correspond to the region of the bottom between one end of the slotted hole and the inner mantle of the body. Furthermore, the other leg preferably rests at the opposite portion of the bottom serving as an abutment surface. This portion corresponds to the region between the other end of the slotted hole and the inner mantle of the body. This may be the inner surface of the other end of the slotted hole. This hooking action of the support member with the wall mounting of the inventive device ensures a sufficient positive-locking connection. The other leg can preferably be arranged at a right angle relative to the bottom of the body of the wall mounting. Since the width of the other leg corresponds to the length of the slotted hole or is slightly smaller and, preferably, the thickness of the one leg and/or the thickness of the other leg preferably corresponds to the width of the slotted hole or is slightly smaller in order to facilitate pushing through and alignment of the support member in the slotted hole, a sufficiently fixed connection between the wall mounting and the support member is ensured. This connection is furthermore easy to release.

Furthermore, in a preferred embodiment it is possible that at the other leg stiffening angled edge portions are arranged perpendicularly to the other leg which, upon positive-locking connection of the support member with the wall mounting of the inventive device, rest at the outer surface of the bottom of the hollow cylindrical body and aid in the prevention of a possible slight pivot action of the support member about a rotational axis extending parallel to the longitudinal axis of the slotted hole. These angled edge portions can be provided with the angled portion embodied as a suspending hook, presenting hook for a front presentation, bag presentation hooks, hooks, clothes hooks, supports for glass shelves, wood shelves, or other shelves, for example, in the form of tubular or T-shaped or L-shaped members. Angled edge portions, angled portions and/or support members can be preferably embodied as a single piece or as a multi-piece member depending upon the requirements and specifications.

In a further advantageous embodiment, the lower end of the outer mantle is beveled and angled or slanted such that the insertion of the wall mounting of the inventive device into the hole drilled into the wall is facilitated since, for example, in the case of a coinciding diameter of the hole with the outer circular surface defined by the outer mantle of the body, a slightly projecting bore or drill remains may make the insertion of the body of the wall mounting more difficult.

BRIEF DESCRIPTION OF THE DRAWINGS

The drawings show schematically at a greatly enlarged scale for reasons of simplification, without claiming representation to scale, one embodiment, not intended to limit the invention.

DESCRIPTION OF PREFERRED EMBODIMENTS

Figure 1:
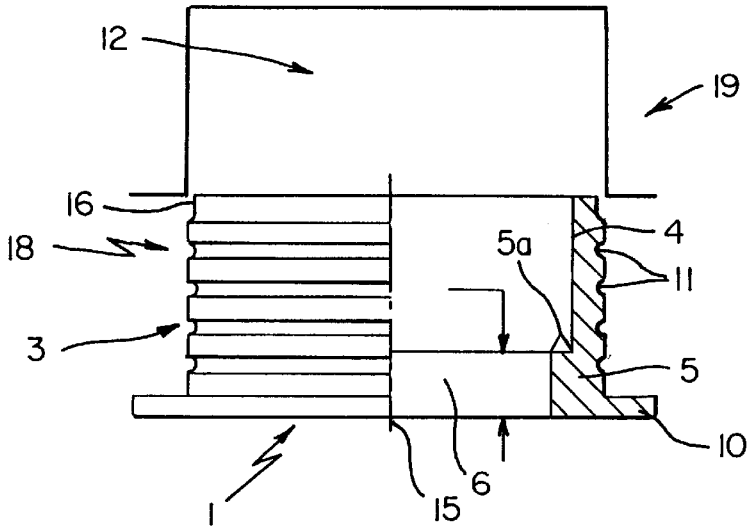
FIG. 1 shows a partial longitudinal section of the wall mounting 1 and a plan view onto the wall mounting 1 of the inventive device.

The wall mounting 1 of the inventive device is embodied as a hollow cylindrical body of the straight type, which has an outer mantle 3 and an inner mantle 4 (FIG. 1). At one end of the hollow cylindrical body a bottom 5 is provided. The hollow cylindrical body is preferably a straight circular cylinder. The inner mantle 4 describes a circle within an inner circular surface having a center of a circle. The outer mantle 3 delimits a circle of the outer circular surface with a center of a circle. The centers of the circles can coincide. The outer and the inner mantles are concentrically arranged about the cylinder axis 15. The bottom 5 has a slotted hole 6 having a longitudinal axis 8 intercepting the centers of the circles, respectively, the cylinder axis. The length of the slotted hole 6 is shorter than the diameter of the inner circular surface delimited by the inner wall. The slotted hole does not extend with its two ends to the outer edge of the inner circular surface so that portions 5*a* are formed. These portions 5*a* of the bottom 5 provide substantially a point of attack or abutment surface for one leg 25 and an abutment surface for the other leg 22 when the support member is in positive-locking connection with the wall mounting 1.

At the upper end 17 of the outer mantle 3 of the hollow cylinder body a lip 10 is arranged which is annularly embodied. The lip 10 can also be provided at the level of the bottom 5 and can extend annularly about it. The surface of the lip 10 which faces the lower end 18 of the outer mantle 3 of the hollow cylindrical body extends at a right angle to the outer mantle. In this embodiment, the thickness of the lip 10 is smaller than that of the bottom 5. The body with outer mantle 3, inner mantle 4, and bottom 5 forms a monolithic part together with the lip 10. It is also possible to connect the lip 10 to the outer mantle 3 by any other means (not shown), for example, by screwing.

Figure 2:
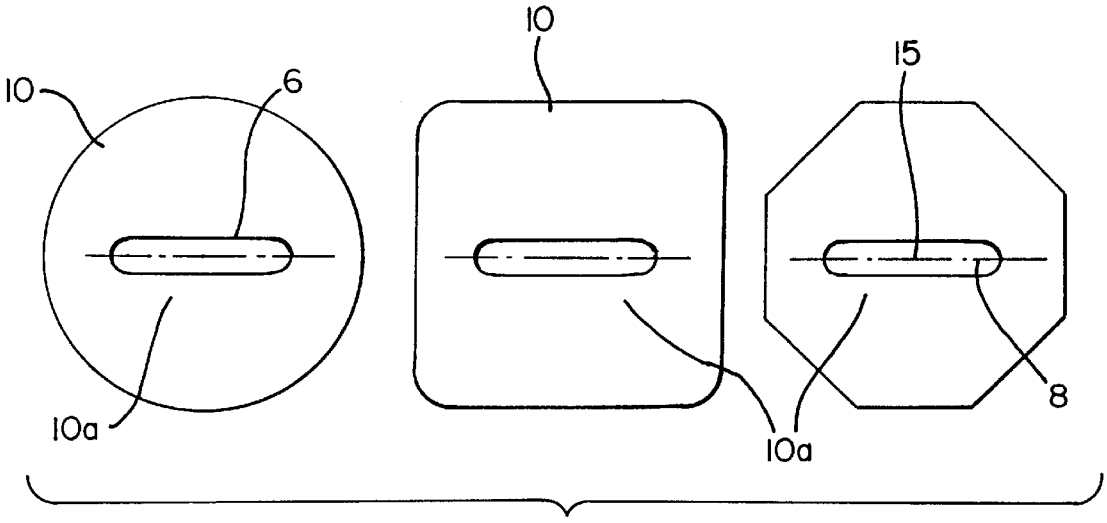
FIG. 2 shows a plan view onto the outer surface 10*a* of the bottom 5 with lip 10 of the hollow cylindrical body of the wall mounting.
Figure 3:
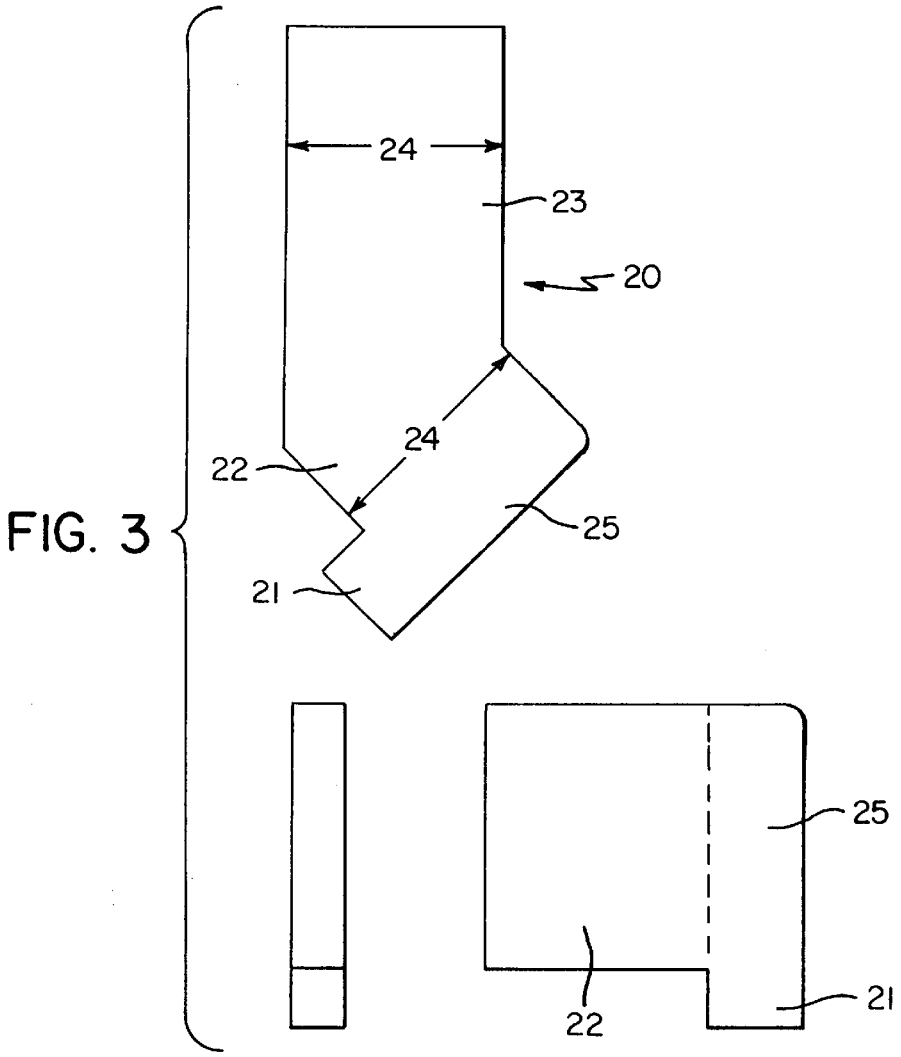
FIG. 3 shows the side view of the support member of the inventive device.

The outer mantle has groove-shaped depressions 11 which extend circularly about the center of the circle as well as the cylinder axis 4 and which are parallel to one another. The lower end 18 of the outer mantle 3 is slanted to form a bevel 16. The slant facilitates insertion of the hollow cylindrical body with its lower end 18 into the drilled hole 12 of a wall 19 whereby the diameter of the hole corresponds to the diameter of the outer circle or outer circular surface described by the outer mantle 3. Minimal deviations usually exhibit no difference with regard to the fixed or force-locking, frictional, or non-positive connection of the hollow cylindrical body in the wall 19. The hollow cylindrical body is inserted into the drilled hole 12 to such an extent that the surface of the lip 10 facing the lower end 18 comes to rest at the wall. A secure abutment of the lip 10 at the wall 19 is especially advantageous in order to prevent slipping of the hollow cylindrical body within the hole 12. The depressions in the form of grooves 11 enhance the form-locking connection of the body with the wall 19, wherein the insertion of the wall mounting 1 by slight hammering onto the wall mounting of the inventive device is possible. The lip 10 can be embodied with an outer mantle 3 such that in a plan view it has a quadrangular, hexagonal, or circular design (FIGS. 2 and 3).

The wall mounting 1 of the inventive device is aligned such within the hole 12 of the wall 19 that the longitudinal axis 8 of the slotted hole 6 is substantially perpendicular or vertical. A certain deviation from the perpendicular or vertical alignment of the slotted hole will not limit the application possibilities of the inventive device.

The support member can be designed as a support for receiving shelf boards and is inserted with its leg 25 into the other leg 22 through the slotted hole 6 to such an extent that the angled portion 21 of the one leg 25 will come to rest at the surface of the portion 5*a* of the bottom 5 facing the bottom 5 which corresponds to the area between one end of the slotted hole 6 and the inner wall 4. At the same time, at least one portion of the surface which faces the outer mantle 3 can come to rest at the portion 5*a*. Subsequently the support member is aligned since the width 24 of the other leg 22 of the L-shaped support member matches the length measured in the longitudinal axis 8 of the slotted hole 6, with certain deviations being possible in order to facilitate insertion or introduction of the other leg 22, and, at the same time, the thickness of the one leg 25 and the thickness of the other leg 22 match the width of the slotted hole 6, a sufficient positive-locking connection by hooking action between the L-shaped support member and the wall mounting of the inventive device is ensured. The width 24 of the other leg 22 can be slightly smaller than the length of the slotted hole 6 in order to facilitate insertion thereof, respectively, introduction into the slotted hole 6. Also, the thickness of the other leg 22 and the leg 25 can be slightly smaller than the width of the slotted hole 6 in order to thus also facilitate insertion into or through the slotted hole 6. This also results in a sufficient positive-locking connection between the wall mounting 1 and the support member. A portion 23 projects from the other leg 22 of the L-shaped support member which is angled from the other leg 22.

The L-shaped support member 20, which is preferably in a detachable engagement at the wall mounting 1, can be provided with angled edge portions 27 for stiffening or stabilizing the engagement at the wall mounting. They extend from the other leg 22 perpendicularly and laterally. Upon insertion of the L-shaped support member into the wall mounting 1, they rest at the surface of the bottom 5 facing away from the wall 19. This prevents a possible minimum pivotability of the L-shaped support member about an axis of rotation which extends parallel to the longitudinal axis 8 of the slotted hole 6. This certain possible pivotability can occur when the thickness of the other leg 22 and that of the one leg 25 of the L-shaped support member is smaller than the width of the longitudinal hole 6.

Figure 4:
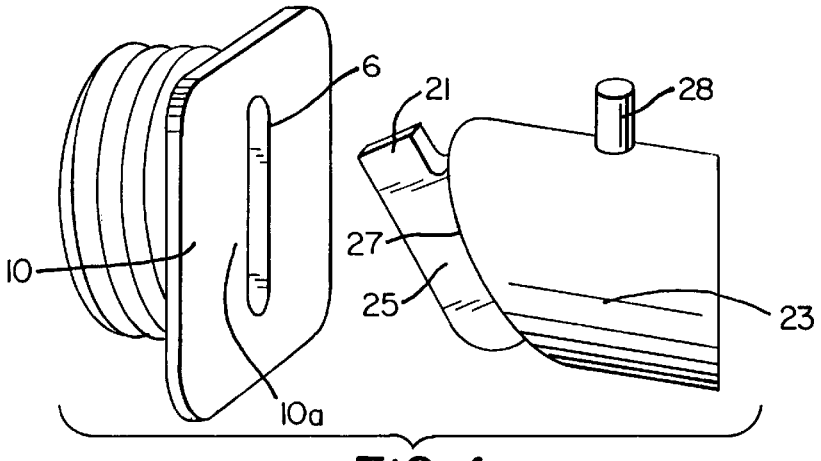
FIG. 4 shows a perspective view of the wall mounting 1 and of the support member of the inventive device.

The portion 23 can be designed as a suspending hook. At the other leg 22 the angled edge portions 27 (FIG. 4) are arranged perpendicularly thereto which upon positive-locking connection of the support member and the wall mounting 1 of the inventive device will rest at the outer surface 10*a* of the bottom 5 of the hollow cylindrical body (FIG. 2). The angled edge portions 27 can have different embodiments. The angled edge portions 27 together with the angled portions 23 can be, for example, embodied as tubular clothes racks with pins 28 which prevent coat hangers from sliding off.

It was found that the inventive device cannot only be mounted with reduced time expenditure by simply drilling a hole 12 into the wall 19, but also that the wall mounting 1 of the inventive device when resting in the wall 19 provides a positive-locking connection between the inventive device and the wall 19 due to the presence of the lip 10, and optionally of the annularly arranged grooves 11 extending about the outer mantle 3 of the hollow cylindrical body. Furthermore, the L-shaped support member engaging the wall mounting 1 results in a positive-locking connection with the wall mounting 1 which is highly loadable. The coupling of the wall mounting 1 can be performed with a wall of any type. Wall mountings 1 of different sizes and diameters can be used depending on the desired application.

Furthermore, the inventive device is also characterized in that the user or interior decorator has many possibilities with regard to attachment, attachment combinations for shelves, other objects etc., substantially independent of the degree of loading because of the mounting of, for example, only one wall mounting with reduced space requirements. In contrast to the prior art, the aesthetic overall appearance is unimpaired as an effect of the technical successful solution, in contrast to the large number of plug and screw anchors or screws required by the prior art. Moreover, the inventive device is beneficial especially in connection with the L-shaped support members by being able to couple thereto a stacked arrangement of supports in a suspended or coupled fashion so that, already upon mounting of two inventive devices, support surfaces and/or suspending devices are made possible. The combination of advantages based on their balanced success is surprising.

What I claim is:

1. A positive-locking wall mounting combination comprising:

a wall mounting (1) comprised of a hollow cylindrical body (2) having an outer mantle (3), an inner mantle (4), and a bottom (5);

said bottom (5) having a slotted hole (6);

said slotted hole (6) having a length that is shorter than an inner diameter of the hollow cylindrical body described by said inner mantle (4);

said slotted hole (6) having a longitudinal axis intercepting a center of a latitude axis of said inner mantle;

said outer mantle (3) having an upper end (17) and a lip (10) connected to said upper end (17), said lip (10) extending annularly about said outer mantle (3);

an L-shaped support member (20) that is locked when inserted into said slotted hole (6).

2. A combination according to claim 1, wherein said L-shaped support member (20) has a first leg (25) and a second leg (22), wherein said first and second legs (25, 22) extend at a right angle to one another, wherein said second leg (22) has an angled portion (23) projecting from said second leg (22).

3. A combination according to claim 1, wherein said lip (10) has a surface facing a lower end (18) of said outer mantle (3) and wherein said surface extends at a right angle to said outer mantle (3).

4. A combination according to claim 2, wherein said second leg (22) has a width matching said length of said slotted hole (6).

5. A combination according to claim 2, wherein said first and said second legs (25, 22) each have a thickness matching a width of said slotted hole (6).

6. A combination according to claim 1, wherein said outer mantle (3) has projections and depressions.

7. A combination according to claim 6, wherein said projections and depressions are groove-shaped.

8. A combination according to claim 6, wherein said depressions are thread-shaped.

9. A combination according to claim 6, wherein said depressions are concentrical to a center axis of said outer mantle (3).

10. A combination according to claim 1, wherein said outer mantle (3) has a lower end and wherein said lower end (18) has a bevel (16).

* * * * *